United States Patent [19]

Nakata et al.

[11] Patent Number: 4,730,179

[45] Date of Patent: Mar. 8, 1988

[54] VOLTAGE NON-LINEAR RESISTOR AND ITS MANUFACTURE

[75] Inventors: Masami Nakata, Aichi; Osamu Imai, Kasugai, both of Japan

[73] Assignee: NGK Insulators, Ltd., Japan

[21] Appl. No.: 80,006

[22] Filed: Jul. 31, 1987

Related U.S. Application Data

[62] Division of Ser. No. 028,394, Mar. 20, 1987.

[30] Foreign Application Priority Data

Nov. 28, 1986 [JP] Japan ..... 61-282139

[51] Int. Cl.[4] ..... H01C 7/10

[52] U.S. Cl. ..... 338/20; 338/21; 427/101; 29/620; 252/518

[58] Field of Search ..... 338/20, 21; 264/61; 427/101, 102, 103; 252/518; 29/610 R, 620

[56] References Cited

U.S. PATENT DOCUMENTS

| | | | |
|---|---|---|---|
| 4,386,021 | 5/1983 | Kazuo et al. | 252/519 |
| 4,516,105 | 5/1985 | Imai et al. | 264/61 |
| 4,549,981 | 10/1985 | Gupta et al. | 264/61 |
| 4,551,268 | 11/1985 | Eda et al. | 252/519 |
| 4,692,735 | 9/1987 | Shoji et al. | 338/21 |

FOREIGN PATENT DOCUMENTS

| | | |
|---|---|---|
| 59-41285 | 5/1984 | Japan . |
| 59-41286 | 5/1984 | Japan . |
| 60-4563 | 5/1985 | Japan . |

*Primary Examiner*—E. A. Goldberg
*Assistant Examiner*—M. Lateef
*Attorney, Agent, or Firm*—Parkhurst & Oliff

[57] ABSTRACT

A voltage non-linear resistor excellent in varistor voltage characteristics, lightning discharge current withstanding capability and life performance against applied voltage comprises a disc-like voltage non-linear element and a thin insulating covering layer integrally provided on the side surface of said element. In the resistor according to the invention, said element comprises zinc oxides as main ingredient, 0.1–2.0% bismuth oxides, as $Bi_2O_3$, 0.1–2.0% cobalt oxides, as $CO_2O_3$, 0.1–2.0% manganese oxides, as $MnO_2$, 0.1–2.0% antimony oxides, as $Sb_2O_3$, 0.1–2.0% chromium oxides, as $Cr_2O_3$, 0.1–2.0% nickel oxides, as NiO, 0.001–0.05% aluminum oxides, as $Al_2O_3$, 0.005–0.1% boron oxides, as $B_2O_3$, 0.001–0.05% silver oxides, as $Ag_2O$ and 7–11% silicon oxides, as $SiO_2$, and said layer comprises 45–60% silicon oxides, as $SiO_2$, 30–50% zinc oxides, as ZnO, 1–5% bismuth oxides, as $Bi_2O_3$ and antimony oxides for the remainder (% stands for mole %). The resistor of the invention preferably further comprises a thin glassy layer superimposed on the insulating covering layer. The resistors are advantageously adaptable to arrestors, surge absorbers used in high voltage power systems.

6 Claims, No Drawings

VOLTAGE NON-LINEAR RESISTOR AND ITS MANUFACTURE

This is a division of application Ser. No. 028,394 filed Nov. 20, 1987.

BACKGROUND OF THE INVENTION

1. Field of the Invention

The present invention relates to a voltage non-linear resistor comprising, as its main ingredient, zinc oxides, and more particularly a voltage non-linear resistor which is excellent in varistor voltage (VlmA) characteristics, lightning discharge current withstanding capability and life performance against applied voltage, and exhibits a strong coherency between its disc-like resistance element and insulating covering layer, and also to a process for manufacturing the same.

2. Description of the Prior Art

As a manufacturing process of voltage non-linear resistors having been heretofore extensively utilized in voltage stabilizing devices, surge absorbers, arrestors, etc. which have characteristics of acting as an insulator usually but as a conductor when an overcurrent flows, there is widely known, for example, a process for manufacturing a voltage non-linear resistor by forming a disc-like body from a starting material mixture consisting of 0.1–3.0% $Bi_2O_3$, 0.1–3.0% $Co_2O_3$, 0.1–3.0% $MnO_2$, 0.1–3.0% $Sb_2O_3$, 0.05–1.5% $Cr_2O_3$, 0.1–3.0% NiO, 0.1–10.0% $SiO_2$, 0.0005–0.025% $Al_2O_3$, 0.005–0.3% $B_2O_3$ and the remainder of ZnO (% stands for mole %) and then sintering the formed body.

Many attempts have been made to improve various performances of voltage non-linear resistors obtained according to the conventional process, such that, as measures for humidity proof and flashover prevention, a high resistance layer comprising an epoxy resin, etc. is provided on a peripheral surface of a disc-like resistance element or, in order to attain a minification by increasing the varistor voltage, the $SiO_2$ content in the element is increased or a sintering temperature is lowered.

Conventional voltage non-linear resistors manufactured by the above-mentioned process have a wide composition range of components which causes a low cohering strength between the resistance element and the high resistance layers on its peripheral side surface and said cohering strength further decreases with lowering of the sintering temperature, so that flashover of the element has been unable to be effectively prevented. Consequently, a voltage non-linear resistor having a varistor voltage of 400 V/mm or more and being satisfactory in lightning discharge current withstanding capability and ife performance against applied voltage which are particularly important in protection of an electrical insulator, has not been obtainable.

SUMMARY OF THE INVENTION

The object of the present invention is, obviating the above-mentioned inconvenience, to provide a voltage non-linear resistor which is excellent in lightning discharge current withstanding capability and life performance against applied voltage and has a varistor voltage of at least 400 V/mm.

The process of the present invention for manufacturing a voltage non-linear resistor is characterized by applying a mixture comprising 45–60% silicon oxides calculated as $SiO_2$, 30–50% zinc oxides calculated as ZnO, 1–5% bismuth oxides calculated as $Bi_2O_3$ and antimony oxides for the remainder on a peripheral side surface of a disc-like voltage non-linear resistance element comprising zinc oxides as a main ingredient, 0.1–2.0% bismuth oxides calculated as $Bi_2O_3$, 0.1–2.0% cobalt oxides calculated as $Co_2O_3$, 0.1–2.0% manganese oxides calculated as $MnO_2$, 0.1–2.0% antimony oxides calculated as $Sb_2O_3$, 0.1–2.0% chromium oxides calculated as $Cr_2O_3$, 0.1–2.0% nickel oxides calculated as NiO, 0.001–0.05% aluminum oxides calculated as $Al_2O_3$, 0.005–0.1% boron oxides calculated as $B_2O_3$, 0.001–0.05% silver oxides calculated as $Ag_2O$ and 7–11% silicon oxides calculated as $SiO_2$ (% stands for mole %), and then sintering the element, whereby an insulating covering layer is provided integrally on said surface.

DESCRIPTION OF THE PREFERRED EMBODIMENTS

In the above-described structure, the definition of the composition of the voltage non-linear resistance element, in particular, that the content of silicon oxides be 7–11 mol. % as $SiO_2$ and the definition of the composition of the mixture for the insulating covering layer to be applied on the peripheral side surface, in particular, that the content of silicon oxides be 45–60 mol. % as $SiO_2$ and the content of zinc oxides be 30–50 mol. % as ZnO, synergistically increase the cohering strength between the voltage non-linear resistance element and the insulating covering layer and attain a varistor voltage of at least 400 V/mm.

Further, the reasons for defining the content of each ingredient in the voltage non-linear resistance element are as follow.

The bismuth oxides constitute a microstructure, as a grain boundary phase, among zinc oxides grains, while they act to promote growth of the zinc oxides grains. If the bismuth oxides are less than 0.1 mol. % as $Bi_2O_3$, the grain boundary phase is not sufficiently formed, and an electric barrier height formed by the grain boundary phase is lowered to increase leakage currents, whereby non linearity in a low current region will be deteriorated. If the bismuth oxides exceed 2 mol. %, the grain boundary phase becomes too thick or the growth of the zinc oxides grain is promoted, whereby a discharge voltage ratio ($V_{10KA}/V_{1mA}$) will be deteriorated. Accordingly, the content of the bismuth oxides is limited to 0.1–2.0 mol. %, preferably 0.5–1.2 mol. %, calculated as $Bi_2O_3$.

The cobalt oxides and manganese oxides, a part of which forms solid solutions in zinc oxides grains and another part of which deposits in the grain boundary phase, serve to raise the electric barrier height. If either of them is less than 0.1 mol. % as $Co_2O_3$ or $MnO_2$, the electric barrier height will be so lowered that non-linearity in a low current region will be deteriorated, while if in excess of 2 mol. %, the grain boundary phase will become so thick that the discharge voltage ratio will be deteriorated. Accordingly, the respective contents of the cobalt oxides and manganese oxides are limited to 0.1–2.0 mol. % calculated as $Co_2O_3$ and $MnO_2$, preferably 0.5–1.5 mol. % for cobalt oxides and 0.3–0.7 mol. % for manganese oxides.

The antimony oxides, chromium oxides and nickel oxides which react with zinc oxides to form a spinel phase suppress an abnormal growth of zinc oxides grains and serve to improve uniformity of sintered bodies. If any oxides of these three metals are less than 0.1 mol. % calculated as the oxides defined hereinabove, i.e., $Sb_2O_3$, $Cr_2O_3$ or NiO, the abnormal growth of zinc oxides grains will occur to induce nonuniformity of current distribution in sintered bodies, while if in excess of 2.0 mol. % as the defined oxide form, insulating spinel phases will increase too much and also induce a non-uniform current distribution in sintered bodies. Accordingly, respective contents of the antimony oxides, chromium oxides and nickel oxides are limited to 0.1–2.0 mol. % calculated as $Sb_2O_3$, $Cr_2O_3$ and NiO, preferably 0.8–1.2 mol. % as $Sb_2O_3$, 0.3–0.7 mol. % as $Cr_2O_3$ and 0.8–1.2 mol. % as NiO.

The aluminum oxides which form solid solutions in zinc oxides act to reduce the resistance of the zinc oxides containing element. If the aluminum oxides are less than 0.001 mol. % as $Al_2O_3$, the electrical resistance of the element cannot be reduced to a sufficiently small value, so that the discharge voltage ratio will be deteriorated, while, if in excess of 0.05 mol. %, the electric barrier height will be so lowered that the non-linearity in a low current region will be deteriorated. Accordingly, the content of the aluminum oxides is limited to 0.001–0.05 mol. %, preferably 0.002–0.005 mol. %, calculated as $Al_2O_3$.

The boron oxides deposit along with the bismuth oxides and silicon oxides in the grain boundary phase, serve to promote the growth of zinc oxides grains as well as to vitrify and stabilize the grain boundary phase. If the boron oxides are less than 0.005 mol. % as $B_2O_3$, the effect on the grain boundary phase stabilization will be insufficient, while, if in excess of 0.1 mol. %, the grain boundary phase will become too thick, so that the discharge voltage ratio will be deteriorated. Accordingly, the content of the boron oxides is limited to 0.005–0.1 mol. %, preferably 0.01–0.08 mol. %, calculated as $B_2O_3$.

The silver oxides deposit in the grain boundary phase, act to suppress ion migration caused by an applied voltage, to thereby stabilize the grain boundary phase. If the silver oxides are less than 0.001 mol. % as $Ag_2O$, the effect on the grain boundary phase stabilization will be insufficient, while, if greater than 0.05 mol. %, the grain boundary phase will become so unstable, whereby the discharge voltage ratio will be deteriorated. Accordingly, the content of the silver oxides is limited to 0.001–0.05 mol. %, preferably 0.005–0.03 mol. %, calculated as $Ag_2O$.

The silicon oxides deposit along with the bismuth oxides in the grain boundary phase, serve to suppress the growth of zinc oxides grains as well as to increase a varistor voltage. If the silicon oxides are less than 7 mol. % as $SiO_2$, the effect on the growth suppression of zinc oxides grains will be so insufficient that the v ristor voltage will not increase up to 400 V/mm or more and the life performance against applied voltage will be poor, while, if in excess of 11 mol. % as $SiO_2$, the grain boundary phase will become too thick and the lightning discharge current withstanding capability will be impaired. Accordingly, the content of silicon oxides is limited to 7–11 mol. %, preferably 8–10 mol. %, as $SiO_2$.

Further, with respect to the composition of mixtures for the insulating covering layer to be provided on the peripheral side surface of the disc-like voltage non-linear resistance element, if the silicon oxides are less than 45 mol. % as $SiO_2$, the insulating covering layer will exfoliate and the lightning discharge current withstanding capability will not improve, while, if in excess of 60 mol. %, also the lightning discharge current withstanding capability will not improve. Accordingly, the content of silicon oxides is limited to 45–60 mol. %, preferably 48–57 mol. %, calculated as $SiO_2$.

If the content of zinc oxides in the insulating covering layer is less than 30 mol. % as ZnO, the lightning discharge current withstanding capability will not improve, while, if exceeds 50 mol. %, the insulating covering layer will be liable to exfoliate. Accordingly, the content of zinc oxides is limited to 30–50 mol. %, preferably 35–45 mol. %, calculated as ZnO.

Furthermore, if the insulating covering layer is less than 30 μm thick, its effect will be lost, while, if thicker than 100 μm, its coherency will become insufficient so as to induce liability to exfoliation. Accordingly, the thickness is preferred to be 30–100 μm.

As the above, the silicon oxides and zinc oxides in the insulating covering layer provided on the peripheral side surface of the element play an important role in improvement of lightning discharge current withstanding capability of the element, the mechanism of which is accounted as follows.

The insulating covering layer is formed from a mixture for insulating cover comprising silicon oxides, zinc oxides, antimony oxides and bismuth oxides, which is applied onto the element and sintered. Then, the silicon oxides and antimony oxides in the mixture for insulating cover react with the zinc oxides in the element during the sintering. This insulating covering layer consists mainly of zinc silicate ($Zn_2SiO_4$) derived from reaction of zinc oxides with silicon oxides and a spinel ($Zn_{7/3}Sb_{2/3}O_4$) derived from reaction of zinc oxides with antimony oxides, which are formed at portions where the zinc silicate is in contact with the element. Therefore, it is considered that the silicon oxides and zinc oxides in the mixture for the insulating cover play an important role in coherency between the element and the insulating covering layer.

On the other hand, the bismuth oxides serve as a flux which acts to promote the above-described reactions smoothly. Accordingly, they are preferred to be contained in an amount of 1–5 mol. %, as $Bi_2O_3$.

In order to obtain a voltage non-linear resistor comprising zinc oxides as a main ingredient, a zinc oxides material having a particle size adjusted as predetermined is mixed, for 50 hours in a ball mill, with a predetermined amount of an additive comprising respective oxides of Bi, Co, Mn, Sb, Cr, Si, Ni, Al, B, Ag, etc. having a particle size adjusted as predetermined. The thus prepared starting powder is added with a predetermined amount of polyvinylalcohol aqueous solution as a binder and, after granulation, formed into a predetermined shape, preferably a disc, under a forming pressure of 800–1,000 kg/cm$^2$. The formed body is provisionally calcined under conditions of heating and cooling rates of 50°–70° C./hr. and a retention time at 800°–1,000° C. of 1–5 hours, to expel and remove the binder.

Next, the insulating covering layer is formed on the peripheral side surface of the provisional calcined disc-like body. In the present invention, an oxide paste comprising bismuth oxides, antimony oxides, zinc oxides and silicon oxides admixed with ethyl-cellulose, butyl carbitol, n-butylacetate or the like as an organic binder, is applied to form layers 60–300 μm thick on the peripheral side surface of the provisional calcined disc-like body. Then, this is subjected to a main sintering under conditions of heating and cooling rates of 40°–60° C./hr. and a retention time at 1,000°–1,300° C., preferably at 1,000°-1,120° C., of 2-7 hours, and a voltage non-linear resistor comprising a disc-like element and an insulating covering layer with a thickness of about 30-100 μm is obtained.

Besides, it is preferred that a glass paste comprising glass powder admixed with ethylcellulose, butyl carbitol, n-butylacetate or the like as an organic binder, is applied with a thickness of 100-300 μm onto the aforementioned insulating covering layer and then heat-treated in air under conditions of heating and cooling rates of 100°-200° C./hr. and a temperature retention time at 400°-600° C. of 0.5-2 hours, to superimpose a glassy layer with a thickness of about 50-100 μm.

Then lastly, both the top and bottom flat surfaces of the disc-like voltage non-linear resistor are polished to smooth and provided with aluminum electrodes by means of metallizing.

With respect to voltage non-linear resistors prepared with compositions respectively inside and outside the scope of the invention, results of measurement on various characteristics will be explained hereinafter.

In examples, silicon oxides, zinc oxides, bismuth oxides and antimony oxides are contained as an oxide paste and, needless to say, an equivalent effect will be realized with carbonates, hydroxides, etc. which can be converted to oxides during the firing. Also it is needless to say that, other than silicon, zinc, antimony and bismuth compounds, any materials not to impair effects of these compounds may be added to the paste in accordance with the purpose of use of the voltage non-linear resistor. On the other hand, with respect to the composition of the element also the same can be said.

EXAMPLE 1

Specimens of disc-like voltage non-linear resistors of 47 mm in diameter and 20 mm in thickness were prepared in accordance with the above-described process, which had silicon oxides contents calculated as $SiO_2$ in the disc-like element and silicon oxides and zinc oxides contents in the mixture for insulating covering layer on the peripheral side surface of the element, either inside or outside the scope of the invention, as shown in Table 1 below. With respect to each specimen, appearance of element and lightning discharge current withstanding capability were evaluated. The insulating covering layer of every specimen had a thickness in the range of 30-100 μm, and all of the voltage non-linear resistors were provided with a glassy layer 50-100 μm thick. The result is shown in Table 1. For the appearance of element in Table 1, the mark O denotes no exfoliation of insulating covering layer observed apparently and the mark × denotes exfoliation observed. Further, the lightning discharge current withstanding capability means withstandability against impulse current having a waveform of 4×10 μs and, the mark O denotes no flashover occurred upon twice applications and the mark × denotes flashover occurred. Further, the varistor voltage was determined as the value obtained by dividing a voltage when the current of 1 mA flows in the element by the thickness of the element. Furthermore, the life performance against applied voltage was evaluated by the change with time of leakage current flowing through the element when a voltage of 95% of the varistor voltage (VlmA) (herein referred to as AVR 95%) was applied while the ambient temperature was maintained at 150° C., and represented by the time required for the leakage current to exceed 10 mA.

TABLE 1

| Specimen No. | Composition of Element (mol. %) | | | | | | | | | | | Composition of Mixture for Insulating Covering Layer (mol. %) | | | | Appearance of Element | Varistor Voltage (V/mm) | Lightning Discharge Current Withstanding Capability (KA) | | | | | | Life Performance against Applied Voltage 150° C. AVR 95% |
|---|---|---|---|---|---|---|---|---|---|---|---|---|---|---|---|---|---|---|---|---|---|---|---|---|
| | $Bi_2O_3$ | $Co_2O_3$ | $MnO_2$ | $Sb_2O_3$ | $Cr_2O_3$ | NiO | $SiO_2$ | $Al_2O_3$ | $B_2O_3$ | $Ag_2O$ | ZnO | $SiO_2$ | ZnO | $Bi_2O_3$ | $Sb_2O_3$ | | | 50 | 60 | 70 | 80 | 90 | 100 | |
| 1 | 0.5 | 1.0 | 0.5 | 1.0 | 0.5 | 1.0 | 6.0 | 0.005 | 0.03 | 0.02 | remainder | 45 | 50 | 2 | 3 | O | 371 | O | O | O | O | O | O | 103 hr |
| 2 | 0.5 | 1.0 | 0.5 | 1.0 | 0.5 | 1.0 | 6.0 | 0.005 | 0.03 | 0.02 | " | 50 | 40 | 3 | 7 | O | 372 | O | O | O | O | O | O | 102 hr |
| 3 | 1.0 | 0.5 | 1.0 | 0.5 | 1.0 | 0.5 | 6.0 | 0.02 | 0.05 | 0.005 | " | 55 | 35 | 3 | 7 | O | 375 | O | O | O | O | O | O | 150 hr |
| 4 | 1.0 | 0.5 | 1.0 | 0.5 | 1.0 | 0.5 | 6.0 | 0.02 | 0.05 | 0.005 | " | 60 | 30 | 3 | 7 | O | 374 | O | O | O | O | O | O | 148 hr |
| 5 | 0.1 | 1.0 | 1.3 | 1.7 | 2.0 | 0.1 | 7.0 | 0.001 | 0.005 | 0.02 | " | 45 | 30 | 5 | 20 | O | 412 | O | O | O | O | O | X | 1000 hr or more |
| 6 | 0.1 | 1.0 | 1.3 | 1.7 | 2.0 | 0.1 | 7.0 | 0.001 | 0.005 | 0.02 | " | 45 | 50 | 2 | 3 | O | 411 | O | O | O | O | O | O | 850 hr |
| 7 | 0.1 | 1.0 | 1.3 | 1.7 | 2.0 | 0.1 | 7.0 | 0.001 | 0.005 | 0.02 | " | 50 | 40 | 3 | 7 | O | 409 | O | O | O | O | O | O | 1000 hr or more |
| 8 | 1.0 | 1.3 | 1.7 | 2.0 | 0.1 | 1.3 | 7.0 | 0.01 | 0.015 | 0.04 | " | 55 | 35 | 3 | 7 | O | 412 | O | O | O | O | O | O | " |
| 9 | 1.0 | 1.3 | 1.7 | 2.0 | 0.1 | 1.3 | 7.0 | 0.01 | 0.015 | 0.04 | " | 60 | 30 | 3 | 7 | O | 411 | O | O | O | O | O | O | " |
| 10 | 1.0 | 1.3 | 1.7 | 2.0 | 0.1 | 1.3 | 7.0 | 0.01 | 0.015 | 0.04 | " | 60 | 38 | 1 | 1 | O | 410 | O | O | O | O | O | O | " |
| 11 | 1.3 | 1.7 | 2.0 | 0.1 | 1.3 | 0.5 | 7.0 | 0.02 | 0.03 | 0.001 | " | 30 | 60 | 3 | 7 | X | — | | | | | | | |
| 12 | 1.3 | 1.7 | 2.0 | 0.1 | 1.3 | 0.5 | 7.0 | 0.02 | 0.03 | 0.001 | " | 40 | 50 | 3 | 7 | O | 412 | O | X | | | | | |
| 13 | 1.3 | 1.7 | 2.0 | 0.1 | 1.3 | 0.5 | 7.0 | 0.02 | 0.03 | 0.001 | " | 65 | 25 | 3 | 7 | O | 415 | O | O | X | | | | |
| 14 | 1.7 | 2.0 | 0.1 | 0.5 | 1.0 | 1.7 | 7.0 | 0.04 | 0.08 | 0.05 | " | 70 | 20 | 3 | 7 | O | 408 | O | O | O | X | | | |
| 15 | 1.7 | 2.0 | 0.1 | 0.5 | 1.0 | 1.7 | 7.0 | 0.04 | 0.08 | 0.05 | " | 65 | 30 | 2 | 3 | O | 409 | O | O | O | X | | | |
| 16 | 1.7 | 2.0 | 0.1 | 0.5 | 1.0 | 1.7 | 7.0 | 0.04 | 0.08 | 0.05 | " | 60 | 20 | 5 | 15 | O | 410 | X | | | | | | |
| 17 | 2.0 | 0.1 | 1.0 | 1.3 | 1.7 | 2.0 | 9.0 | 0.05 | 0.1 | 0.005 | " | 45 | 30 | 5 | 20 | O | 513 | O | O | O | O | O | X | 1000 hr or more |
| 18 | 2.0 | 0.1 | 1.0 | 1.3 | 1.7 | 2.0 | 9.0 | 0.05 | 0.1 | 0.005 | " | 45 | 50 | 2 | 3 | O | 512 | O | O | O | O | O | O | " |
| 19 | 2.0 | 0.1 | 1.0 | 1.3 | 1.7 | 2.0 | 9.0 | 0.05 | 0.1 | 0.005 | " | 50 | 40 | 3 | 7 | O | 510 | O | O | O | O | O | O | " |
| 20 | 0.5 | 0.5 | 0.5 | 1.0 | 0.5 | 1.0 | 9.0 | 0.005 | 0.05 | 0.01 | " | 55 | 35 | 3 | 7 | O | 508 | O | O | O | O | O | O | " |
| 21 | 0.5 | 0.5 | 0.5 | 1.0 | 0.5 | 1.0 | 9.0 | 0.005 | 0.05 | 0.01 | " | 60 | 30 | 3 | 7 | O | 511 | O | O | O | O | O | O | " |
| 22 | 0.5 | 0.5 | 0.5 | 1.0 | 0.5 | 1.0 | 9.0 | 0.005 | 0.05 | 0.01 | " | 60 | 38 | 1 | 1 | O | 510 | O | O | O | O | O | O | " |
| 23 | 0.1 | 0.5 | 1.0 | 1.3 | 1.7 | 2.0 | 9.0 | 0.001 | 0.005 | 0.01 | " | 30 | 60 | 3 | 7 | X | — | | | | | | | |
| 24 | 0.1 | 0.5 | 1.0 | 1.3 | 1.7 | 2.0 | 9.0 | 0.001 | 0.005 | 0.01 | " | 40 | 50 | 3 | 7 | O | 508 | O | X | X | | | | |
| 25 | 0.1 | 0.5 | 1.0 | 1.3 | 1.7 | 2.0 | 9.0 | 0.001 | 0.005 | 0.01 | " | 65 | 25 | 3 | 7 | O | 510 | O | O | O | X | | | |
| 26 | 0.5 | 1.0 | 1.3 | 1.7 | 2.0 | 0.1 | 9.0 | 0.005 | 0.015 | 0.02 | " | 70 | 20 | 3 | 7 | O | 511 | O | O | O | X | | | |
| 27 | 0.5 | 1.0 | 1.3 | 1.7 | 2.0 | 0.1 | 9.0 | 0.005 | 0.015 | 0.02 | " | 65 | 30 | 2 | 3 | O | 512 | O | O | O | X | | | |
| 28 | 0.5 | 1.0 | 1.3 | 1.7 | 2.0 | 0.1 | 9.0 | 0.005 | 0.015 | 0.02 | " | 60 | 20 | 5 | 15 | O | 508 | O | O | X | | | | |
| 29 | 1.0 | 1.3 | 1.7 | 2.0 | 0.1 | 0.5 | 11.0 | 0.01 | 0.03 | 0.001 | " | 45 | 30 | 5 | 20 | O | 610 | O | O | O | O | O | X | 1000 hr or more |
| 30 | 1.0 | 1.3 | 1.7 | 2.0 | 0.1 | 0.5 | 11.0 | 0.01 | 0.03 | 0.001 | " | 45 | 50 | 2 | 3 | O | 609 | O | O | O | O | O | X | " |
| 31 | 1.0 | 1.3 | 1.7 | 2.0 | 0.1 | 0.5 | 11.0 | 0.01 | 0.03 | 0.001 | " | 50 | 40 | 3 | 7 | O | 607 | O | O | O | O | O | O | " |
| 32 | 1.3 | 1.7 | 2.0 | 0.1 | 0.5 | 1.0 | 11.0 | 0.02 | 0.05 | 0.005 | " | 55 | 35 | 3 | 7 | O | 610 | O | O | O | O | O | X | " |
| 33 | 1.3 | 1.7 | 2.0 | 0.1 | 0.5 | 1.0 | 11.0 | 0.02 | 0.05 | 0.005 | " | 60 | 30 | 3 | 7 | O | 608 | O | O | O | O | O | X | " |
| 34 | 1.3 | 1.7 | 2.0 | 0.1 | 0.5 | 1.0 | 11.0 | 0.02 | 0.05 | 0.005 | " | 60 | 38 | 1 | 1 | O | 612 | O | O | O | O | O | X | " |
| 35 | 1.7 | 2.0 | 0.1 | 0.5 | 1.0 | 1.3 | 11.0 | 0.04 | 0.08 | 0.05 | " | 30 | 60 | 3 | 7 | X | — | | | | | | | |
| 36 | 1.7 | 2.0 | 0.1 | 0.5 | 1.0 | 1.3 | 11.0 | 0.04 | 0.08 | 0.05 | " | 40 | 50 | 3 | 7 | O | 610 | O | O | X | | | | |
| 37 | 1.7 | 2.0 | 0.1 | 0.5 | 1.0 | 1.3 | 11.0 | 0.04 | 0.08 | 0.05 | " | 65 | 25 | 3 | 7 | O | 608 | O | O | O | X | | | |
| 38 | 2.0 | 0.1 | 0.5 | 1.0 | 1.3 | 1.7 | 11.0 | 0.05 | 0.1 | 0.04 | " | 70 | 20 | 3 | 7 | O | 609 | O | O | O | X | | | |
| 39 | 2.0 | 0.1 | 0.5 | 1.0 | 1.3 | 1.7 | 11.0 | 0.05 | 0.1 | 0.04 | " | 65 | 30 | 2 | 3 | O | 609 | O | O | O | X | | | |
| 40 | 2.0 | 0.1 | 0.5 | 1.0 | 1.3 | 1.7 | 11.0 | 0.05 | 0.1 | 0.04 | " | 60 | 20 | 5 | 15 | O | 610 | O | X | | | | | |
| 41 | 0.5 | 1.0 | 0.5 | 1.0 | 0.5 | 1.0 | 12.0 | 0.005 | 0.03 | 0.02 | " | 45 | 50 | 2 | 3 | O | 630 | O | X | | | | | 1000 hr or more |
| 42 | 0.5 | 1.0 | 0.5 | 1.0 | 0.5 | 1.0 | 12.0 | 0.005 | 0.03 | 0.02 | " | 50 | 40 | 3 | 7 | O | 628 | O | X | | | | | " |
| 43 | 1.0 | 0.5 | 1.0 | 0.5 | 1.0 | 0.5 | 12.0 | 0.02 | 0.05 | 0.05 | " | 55 | 35 | 3 | 7 | O | 627 | O | X | | | | | " |
| 44 | 1.0 | 0.5 | 1.0 | 0.5 | 1.0 | 0.5 | 12.0 | 0.02 | 0.05 | 0.05 | " | 60 | 30 | 3 | 7 | O | 625 | O | X | | | | | " |

As is clear from the result shown in Table 1, voltage non-linear resistors composed of an element and insulating covering layer both having a composition in the scope of the present invention are good in appearance of element, varistor voltage, lightning discharge current withstanding capability and life performance against applied voltage, while voltage non-linear resistors having either one of compositions outside the scope of the invention are not satisfactory in respect to the appearance of element, varistor voltage, lightning discharge current withstanding capability and life performance against applied voltage.

EXAMPLE 2

Similarly, specimens of disc-like voltage non-linear resistor of 47 mm in diameter and 20 mm in thickness were prepared in accordance with the above-described process, the element of which had a composition specified to one point within the range defined according to the invention and the insulating covering layer of which had a variety of compositions, as shown in Table 2 below. With respect to each specimen, the lightning discharge current withstanding capability were evaluated. The result is shown in Table 2.

TABLE 2

| Composition of Element (mol. %) | Composition of Mixture for Insulating Covering Layer (mol %) | | | | Lightning Discharge Current Withstanding Capability (KA) | | | | | |
|---|---|---|---|---|---|---|---|---|---|---|
| | $SiO_2$ | ZnO | $Bi_2O_3$ | $Sb_2O_3$ | 50 | 60 | 70 | 80 | 90 | 100 |
| $Bi_2O_3$:0.5 | 45 | 30 | 0 | 25 | O | O | O | O | X | |
| $Co_2O_3$:0.5 | | | 1 | 24 | O | O | O | O | O | X |
| $MnO_2$:0.5 | | | 3 | 22 | O | O | O | O | O | O |
| $Sb_2O_3$:1.0 | | | 5 | 20 | O | O | O | O | O | X |
| $Cr_2O_3$:0.5 | | | 7 | 18 | O | O | O | O | X | |
| NiO:1.0 | 45 | 50 | 0 | 5 | O | O | O | O | X | |
| $SiO_2$:9.0 | | | 1 | 4 | O | O | O | O | O | O |
| $Al_2O_3$:0.005 | | | 3 | 2 | O | O | O | O | O | O |
| $B_2O_3$:0.05 | | | 5 | 0 | O | O | O | O | X | |
| $Ag_2O$:0.01 | 50 | 40 | 0 | 10 | O | O | O | O | X | |
| ZnO: | | | 1 | 9 | O | O | O | O | O | O |
| remainder | | | 3 | 7 | O | O | O | O | O | O |
| | | | 5 | 5 | O | O | O | O | O | O |
| | | | 7 | 3 | O | O | O | O | X | |
| | 60 | 30 | 0 | 10 | O | O | O | O | X | |
| | | | 1 | 9 | O | O | O | O | O | X |
| | | | 3 | 7 | O | O | O | O | O | O |
| | | | 5 | 5 | O | O | O | O | O | X |
| | | | 7 | 3 | O | O | O | O | X | |

As is clear from the result shown in Table 2, voltage non-linear resistors comprising an insulating covering layer having a composition in the scope of the present invention are good in the lightning discharge current withstanding capability, while voltage non-linear resistors comprising an insulating covering layer having a composition outside the scope of the present invention are not satisfactory in respect of the lightning discharge current withstanding capability.

While there has been shown and described the preferred embodiments of the present invention, it will be obvious to those skilled in the art that various alterations and modifications thereof can be made without departing from the scope of the invention as defined by the claims. For example, although metallized aluminum electrodes were used in the foregoing examples, other metals such as gold, silver, copper, zinc and the like, alloys thereof, etc. also can be used. With respect to the means to forming electrodes, use can be made of, not only metallizing, but also screen printing, vapor deposition etc.

As is clear from the above detailed explanation, according to the process of the invention for manufacturing voltage non-linear resistors, by combination of a voltage non-linear resistance element with an insulating covering layer both having a specified composition, a voltage non-linear resistor can be obtained which has a strong coherency between the voltage non-linear resistance element and the insulating covering layer, and is consequently excellent in lightning discharge current withstanding capability as well as life performance against applied voltage and which has a high varistor voltage and, moreover, can be minified. The voltage non-linear resistors according to the present invention are, therefore, particularly suitable for use as arrestors, surge absorbers, etc. such as employed in high voltage power systems.

What is claimed is:

1. A voltage non-linear resistor comprising a disc-like voltage non-linear resistance element and a thin insulating covering layer integrally provided on a peripheral side surface of said disc-like element, wherein said element comprises zinc oxides as a main ingredient, 0.1–2.0 mol. % bismuth oxides calculated as $Bi_2O_3$, 0.1–2.0 mol. % cobalt oxides calculated as $Co_2O_3$, 0.1–2.0 mol. % manganese oxides calculated as $MnO_2$, 0.1–2.0 mol. % antimony oxides calculated as $Sb_2O_3$, 0.1–2.0 mol. % chromium oxides calculated as $Cr_2O_3$, 0.1–2.0 mol. % nickel oxides calculated as NiO, 0.001–0.05 mol. % aluminum oxides calculated as $Al_2O_3$, 0.005–0.1 mol. % boron oxides calculated as $B_2O_3$, 0.001–0.05 mol. % silver oxides calculated as $Ag_2O$ and 7–11 mol. % silicon oxides calculated as $SiO_2$, and said layer comprises 45–60 mol. % silicon oxides calculated as $SiO_2$, 30–50 mol. % zinc oxides calculated as ZnO, 1–5 mol. % bismuth oxides calculated as $Bi_2O_3$ and antimony oxides for the remainder.

2. A voltage non-linear resistor as claimed in claim 1, wherein said element comprises 0.5–1.2 mol. % bismuth oxides, as $Bi_2O_3$, 0.5–1.5 mol. % cobalt oxides, as $Co_2O_3$, 0.3–0.7 mol. % manganese oxides, as $MnO_2$, 0.8–1.2 mol. % antimony oxides, as $Sb_2O_3$, 0.3–0.7 mol. % chromium oxides, as $Cr_2O_3$, 0.8–1.2 mol. % nickel oxides, as NiO, 0.002–0.005 mol. % aluminum oxides, as $Al_2O_3$, 0.01–0.08 mol. % boron oxides, as $B_2O_3$, 0.005–0.03 mol. % silver oxides, as $Ag_2O$, and 8–10 mol.

% silicon oxides, as $SiO_2$, and said layer comprises 48–57 mol. % silicon oxides, as $SiO_2$ and 35–45 mol. % zinc oxides, as ZnO.

3. A voltage non-linear resistor as claimed in claim 1, wherein a boundary portion between said element and said layer comprises zinc silicate and a spinel $Zn_{7/3}Sb_{2/3}O_4$.

4. A voltage non-linear resistor as claimed in claim 1, wherein said layer has a thickness of 30–100 μm.

5. A voltage non-linear resistor as claimed in claim 1, which further comprises a glassy layer superimposed on the thin insulating covering layer.

6. A voltage non-linear resistor as claimed in claim 5, wherein the glassy layer has a thickness of 50–100 μm.

* * * * *